US006729481B1

(12) United States Patent
O'Brien

(10) Patent No.: US 6,729,481 B1
(45) Date of Patent: May 4, 2004

(54) WINE RACK APPARATUS

(76) Inventor: John J. O'Brien, 4761 Lone Star Rd., Lorton, VA (US) 22079-1850

( * ) Notice: Subject to any disclaimer, the term of this patent is extended or adjusted under 35 U.S.C. 154(b) by 0 days.

(21) Appl. No.: 10/280,862

(22) Filed: Oct. 25, 2002

Related U.S. Application Data

(60) Provisional application No. 60/330,573, filed on Oct. 25, 2001.

(51) Int. Cl.[7] ..... A47F 7/00

(52) U.S. Cl. ..... 211/74; D7/701; D7/708

(58) Field of Search ..... D7/708, 701; 211/74

(56) References Cited

U.S. PATENT DOCUMENTS 2,008,748 A * 7/1935 Crow
2,622,741 A * 12/1952 Bamert ..... 211/74
3,171,542 A * 3/1965 Jacobs et al.
4,282,977 A * 8/1981 Di Lorenzo ..... 211/74
4,290,530 A * 9/1981 Wooster ..... 211/40
4,482,065 A * 11/1984 Altemose ..... 211/74
5,169,009 A * 12/1992 Bomze ..... 211/74
6,364,129 B1 * 4/2002 Dardashti et al. ..... 211/40
6,454,108 B1 * 9/2002 Gerard ..... 211/74
2003/0151335 A1 * 8/2003 Conroy ..... 312/242

* cited by examiner

*Primary Examiner*—Robert W. Gibson, Jr.
(74) *Attorney, Agent, or Firm*—Krieg DeVault Lindy LLP

(57) ABSTRACT

A wine rack apparatus comprising a planar frame having a top, bottom, and two or more spaced-apart vertical supports, the frame defining one or more columns having one or more rows of vertically stacked bottle supports therein, each bottle support comprising a pair of horizontally spaced-apart dowels extending horizontally between adjacent spaced-apart vertical supports, one or more wine bottles able to be supported horizontally therein and transversely vis-à-vis the planar frame.

34 Claims, 7 Drawing Sheets

WINE RACK APPARATUS

This application claims priority based on U.S. Provisional Patent Application Ser. No. 60/330,573 entitled "Wine Rack Apparatus", filed Oct. 25, 2001.

BACKGROUND OF THE INVENTION

Embodiments of the present invention relate to wine racks, and more particularly to a wine rack suitable for storing and displaying wine bottles horizontally and transversely, supported on a pair of substantially parallel dowels extending between transversely adjacent vertical supports

DESCRIPTION OF RELATED ART

U.S. Pat. No. 5,897,003 to Muhlack discloses a wall element for the presentation of goods, such as wine. The longitudinal axis of the bottles are inclined perpendicularly to the wall surface; however the corks are not in direct contact with the inclined wine bottles, which increases the risk that the corks will dry out and air will enter the container, spoiling the wine. The grid extends across the face of the wine bottles, complicating removal of the wine bottle from the wall element, and partially obscuring the wine labels.

U.S. Pat. No. 4,577,765 to Crosby discloses a wine rack for horizontally cradling a plurality of wine bottles. Bottles are cradled by chains which are slidably received in inclined slots extending through a front facing. Two cradles are formed to support each bottle.

U.S. Pat. No. 2,772,787 to Rumford discloses a bottle rack, wherein the bottle rim is supported between two bossed bars. This stores the bottles vertically by suspending them from a rim at the top of the bottle, which rim is not typically found on wine bottles.

U.S. Pat. No. 2,090,108 to Cicero discloses a shoe rack having spaced apart horizontal bars designed to support multiple shoes. The rack is collapsible when not in use.

U.S. Pat. No. 1,404,555 to Smith disclose's a shoe rack having horizontal parallel bi-level rods which are inclined to support a plurality of shoes thereon.

This prior art is representative of racks which store articles relatively horizontally and adjacent to a wall surface. None of the above patents disclose or suggest the embodiments of the present invention.

SUMMARY OF THE EMBODIMENTS

The embodiments of the present invention provide a wine rack apparatus having a planar frame defining one or more columns having one or more rows configured for storing wine bottles or the like therein. Each row comprises a pair of horizontally spaced-apart dowels generally parallel to one another and extending between adjacent vertical supports of the frame that are transversely spaced apart. The pair of dowels is spaced apart sufficiently to support a wine bottle or the like horizontally thereon and transversely within the frame. The ends of each dowel are secured within suitable apertures bored into the vertical supports. The vertical supports are spaced sufficiently apart to receive at least one wine bottle therebetween. The number of vertical supports determines the number of columns in the apparatus. The number of pairs of dowels determines the number of rows in each column.

DETAILED DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DETAILED DESCRIPTION OF SPECIFIC EMBODIMENTS

Figure 1A:
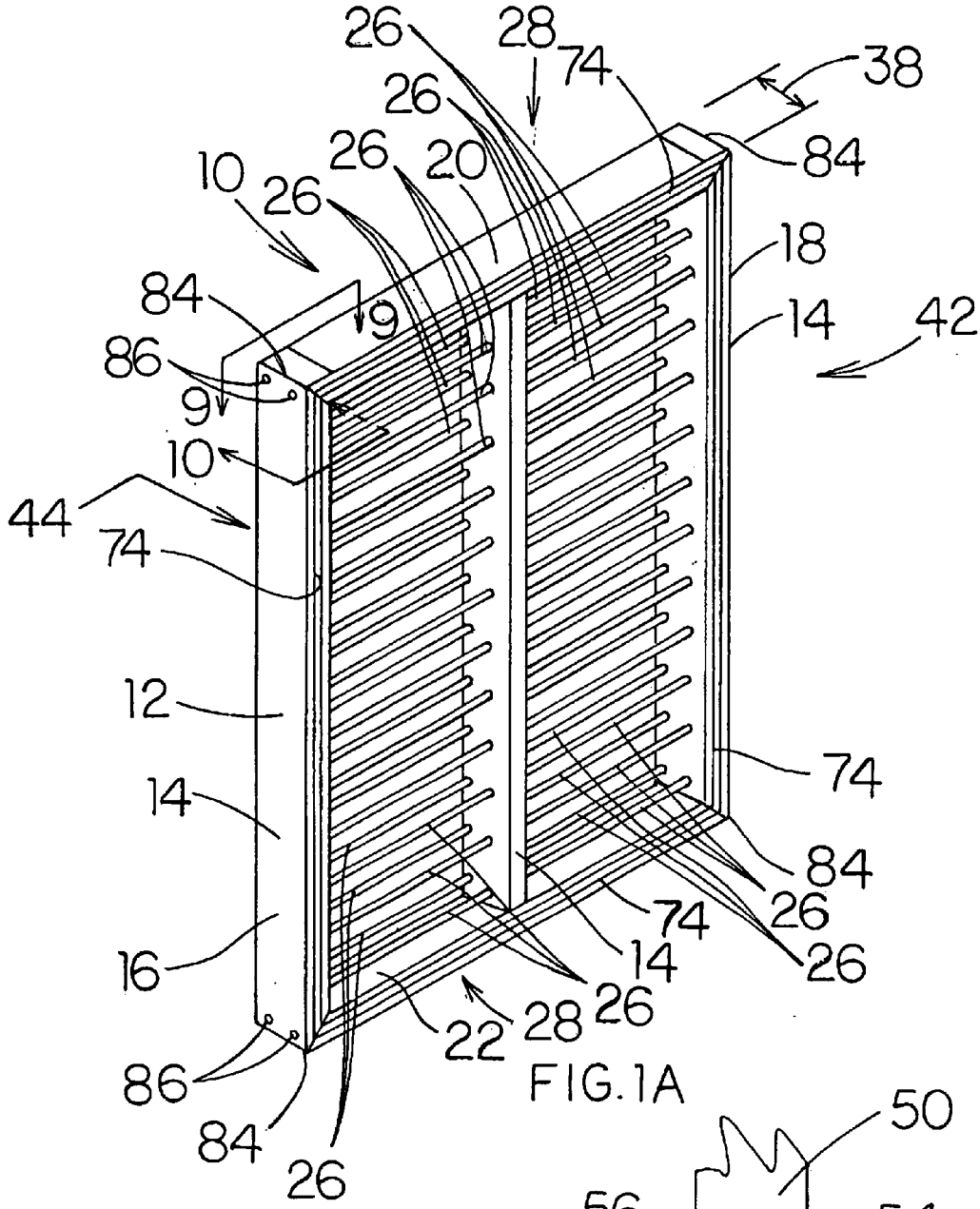
FIG. 1A is a perspective view of the wine rack apparatus, shown without a plurality of wine bottles or the like stored therein.

As shown in the figures, the wine rack apparatus 10 comprises a planar frame 12 having at least two vertical supports 14, two of which vertical supports comprise the first side 16 and the second side 18 of the frame 12, the frame further having a horizontal top 20 and a horizontal bottom 22. The vertical supports 14 are spaced sufficiently apart to transversely receive at least one wine bottle 24 or the like upon a pair of generally horizontally, spaced apart dowels 26 that extend generally horizontally between two adjacent vertical supports 14. Each pair of adjacent vertical supports 14 defines a vertical column 28 within the planar frame 12. Within each column 28 is one or more rows 30, each row 30 defined by one of the pairs of dowels 26, each row spaced vertically apart from every other row a distance sufficient for each row to receive and support a wine bottle 24 or the like horizontally and transversely therein. Each row 30 comprises a bottle support 32 defined by each pair of dowels 26 extending between adjacent vertical supports 14.

Figure 4:
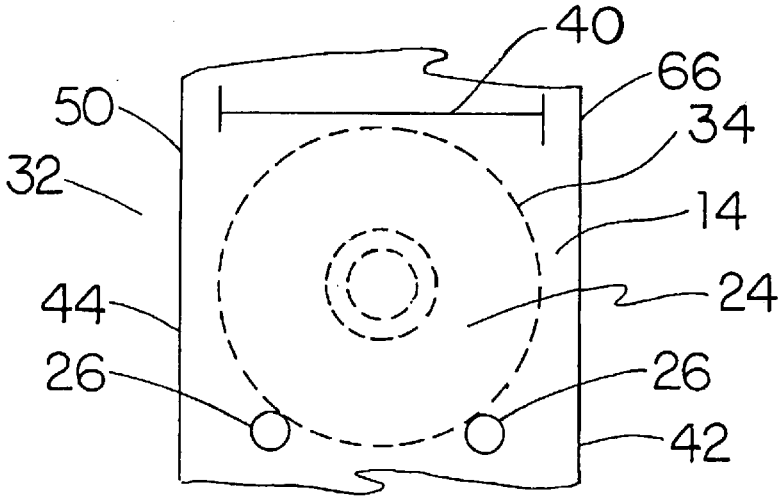
FIG. 4 is a partial cross section view of a bottle support having a wine bottle positioned on a pair of dowels extending from a vertical support, the wine bottle shown in dashed outline.

As shown in FIG. 4, wine bottles 24 are supported within the apparatus 10 by a pair of dowels 26 spaced apart less than the widest thickness 40 of the bottle 24 to be supported thereon. In one embodiment, the pair of dowels 26 is spaced apart approximately two inches. The pair of dowels 26 is spaced apart generally horizontally in order to support the bottle lengthwise, along the outer circumference 34 of the bottle 24. Each dowel 26 may be any shape in its cross-section. In one embodiment, each dowel 26 is circular in cross-section. In other embodiments, each dowel 26 has a thickness to make the dowel sufficiently rigid to support two or more full wine bottles 24 supported thereon end to end between vertical supports 14. In yet other embodiments, each dowel 26 has a thickness from about ⅛ inch to about ½ inch.

Apertures 36 for receiving the ends 37 of each dowel 26 are located in the vertical supports 14. In one embodiment, each dowel aperture 36 is a "blind" aperture, that is, the aperture 36 extends only partially through the vertical support 14 from one side to the other. In other embodiments, the dowel aperture 36 in the vertical supports 14, other than the first and second sides 16, 18, are "through" apertures permitting a longer length of a dowel 26 to extend between more than one set of adjacent vertical supports 14. Whether such apertures 36 are blind or through depends upon manufacturing preference. In yet ,other embodiments, the ends 37 of dowels 26 may be glued within the apertures 36 at assembly of the apparatus 10.

In one embodiment, the depth 38 of the vertical supports 14 and the horizontal top 20 and bottom 22, from the front 42 of the apparatus to the rear 44, is a distance equal to or greater than the widest thickness 40 of a wine bottle 24 to be stored in the apparatus 10. In this way, the outer circumference 34 of the wine bottle 24 does not extend beyond the front 42 or rear 44 of the apparatus 10 when supported therein. In other embodiments, the depth 38 of the vertical supports 14 and the top 20 and bottom 22 is from about 4 inches to about 5 ½ inches. Maintaining a depth 38 of the apparatus 10 that is greater;than the thickness 40 of the largest wine bottle 24 stored within the apparatus 10 enables one to position or mount the apparatus directly adjacent to a vertical wall 46 such that no bottle 24 contacts or is displaced as a result of contact with such vertical wall.

Figure 8:
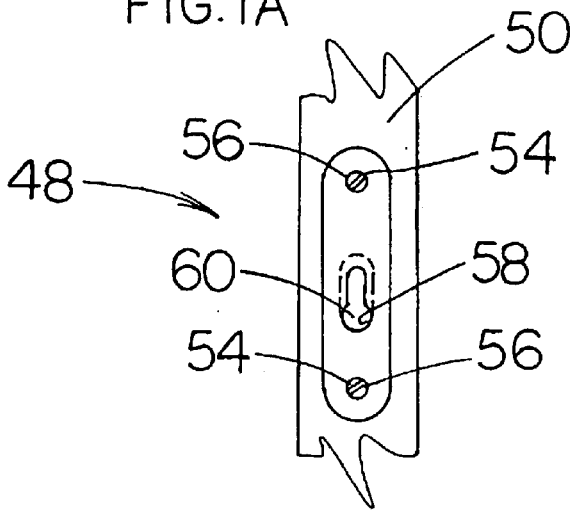
FIG. 8 is a partial rear view of the wine rack apparatus showing an embodiment of a wall mounting device.

In order to mount the apparatus 10 to a vertical wall 46, the apparatus may have one or more mounting devices 48 secured to the rear edge 50 of one or more of the first and second sides 16, 18. An example of such a device 48 is shown in FIG. 8. In another embodiment, a mounting device 48 may be secured to the rear edge 50 of any one or more vertical supports 14 in addition to the first and second sides 16, 18. In the embodiment shown in FIG. 8, the mounting device 48 is a flat, rigid member 52 secured to the apparatus 10 using one or more securement means 54 such as screws, tacks or nails inserted through holes 56 in the rigid member 52 configured to receive such securement means 54. The rigid member 52 has an opening 58 providing access to a cavity 60 bored into the rear 50 of the top 20, bottom 22 or vertical support 14 on which the device 48 is secured. The opening 58, in one embodiment, is rigid and configured to receive the head 64 of a suitable wall mounting means 62, such as a screw, stud or nail, which is secured to the vertical wall 46. In other embodiments, the wall mounting means 62 are secured to wall studs (not shown) located within the vertical wall 46, commonly on 16 inch center-to-center locations. Wall studs within the vertical wall 46 may be located with a magnet, or with other commercially available stud locating tools (not shown). Mounting devices 48 secured to the rear 44 of the apparatus 10 may be aligned with the studs located within the vertical wall 46 in order to support the weight of multiple wine bottles 24 stored upon the apparatus 10.

Mounting the apparatus 10 to a vertical wall 46 in one embodiment requires the apparatus to be supported solely by the wall mounting means 62 inserted within the mounting device 48. Such a mounting is similar to a painting hung on a wall, having no underneath support. In other embodiments, the apparatus 10 is additionally supported by a horizontal surface 68 such a floor and is mounted to the vertical wall 46 to prevent tipping of the top 20 of the apparatus 10 away from the wall 46. In yet other embodiments, the apparatus 10 is secured to a suitable horizontal support surface 68 such as a floor in a free-standing fashion (not shown) either in a stand-alone position or extending radially away from any vertical wall. The horizontal bottom 22 may be secured to the horizontal support surface 68 with suitable fastening means such as screws, bolts, brackets, clips, braces, adhesives, etc. (not shown). In a free-standing configuration, wine bottles 24 may be accessed from either the front 42 or the rear 44 of the apparatus 10.

As shown in FIG. 4, a wine bottle 24, shown in dashed line, is supported upon a pair of dowels 26. A pair of dowels 26 extending between adjacent spaced-apart vertical supports 14 defines a bottle support 32. In one embodiment, the dowels 26 are horizontally spaced apart about two inches, or any distance sufficient to support the wine bottle 24 to be stored thereon, without the wine bottle falling between the pair of dowels. The outer circumference 34 of the wine bottle 24 in FIG. 4 does not extend beyond the front 42 or rear 44 of the apparatus 10. This enables the apparatus 10 to be mounted upon or positioned directly adjacent to a vertical wall 46 such that the wine bottles 24 do not touch the vertical wall 46.

Figure 1B:
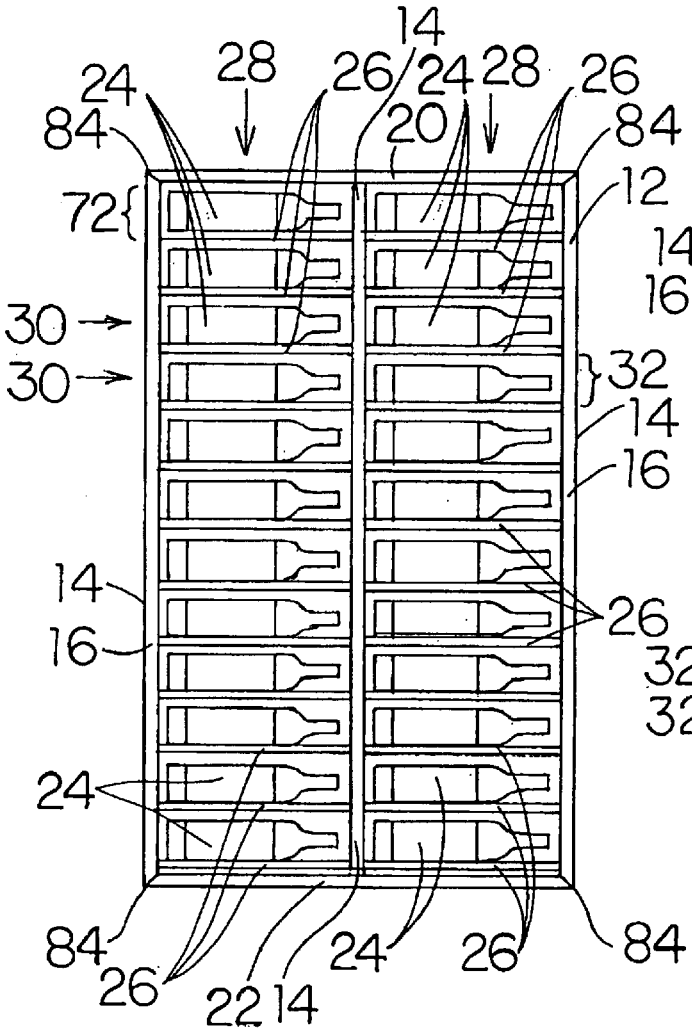
FIG. 1B is a front view of the wine rack apparatus of FIG. 1, showing a plurality of wine bottles or the like stored therein.
Figure 1C:
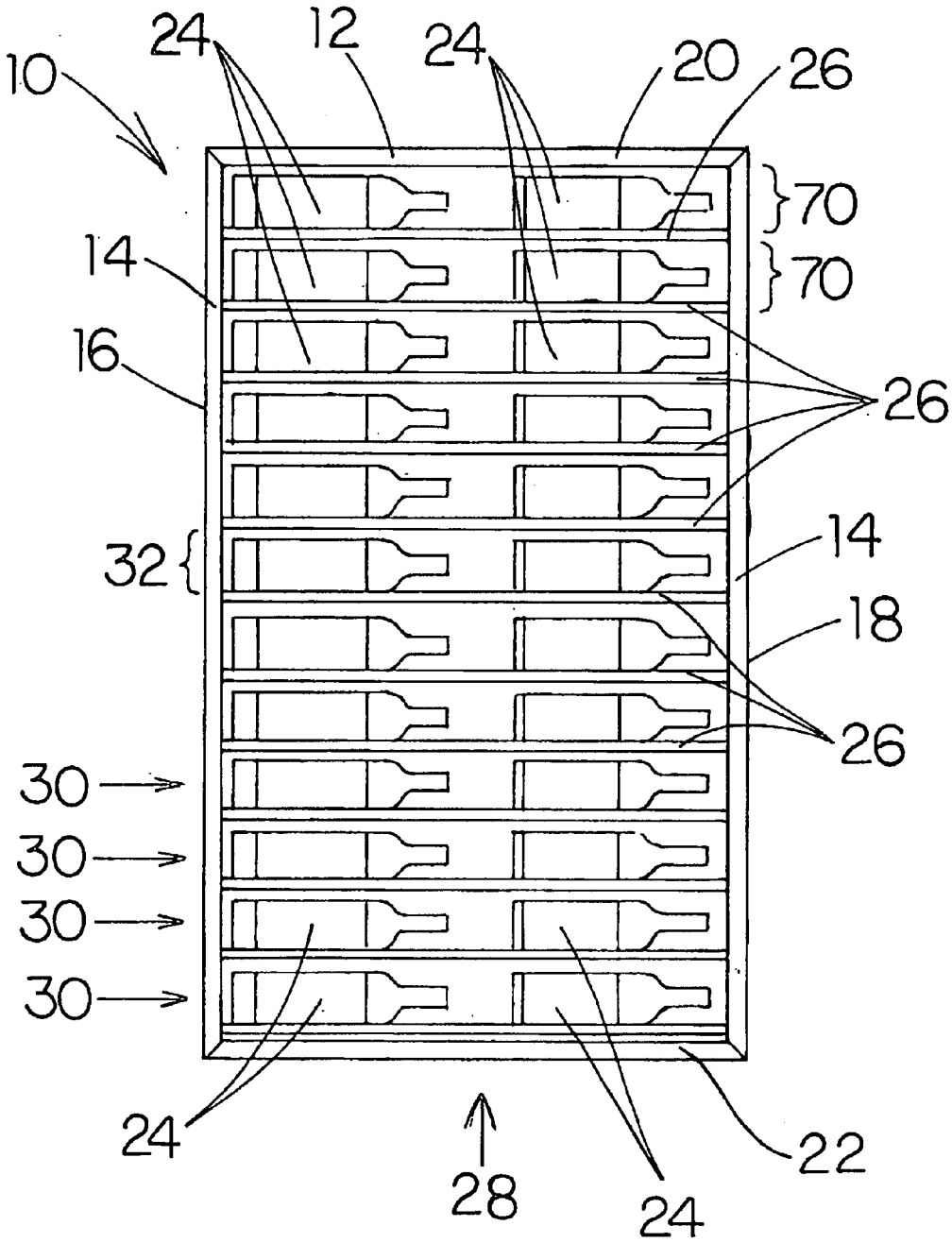
FIG. 1C is a front view of a wine rack apparatus having a single column of multiple bottle supports.

It will be appreciated that some embodiments of the apparatus 10 disclosed herein may provide a planar frame 12 with no vertical supports other than the first side 16 and the second side 18, but having each pair of dowels 26 adapted to receive and support two or more wine bottles 24 laid end to end on their sides transversely between the first and second sides 16, 18. One such embodiment is shown in FIG. 1C and is a single-column apparatus with a multiple bottle support 70 in each row 30. The dowels 26 for multiple bottle supports 70 should be sufficiently rigid to avoid excess blending of each dowel 26 at the midpoint of the extension between the first and second sides 16, 18. In other embodiments, the apparatus 10 has more than one column 28 configured with one or more multiple bottle supports 70. Such a multi-column multiple bottle support configuration (not shown) requires one or more vertical supports 14 spaced between the first and second sides 16, 18.

To avoid the structural limitations of designing a multiple bottle support 70, the bottle supports 32 in each column 28 may be configured to support only one bottle 24 at a time by limiting the spacing between vertical supports 14 to the length of the longest bottle to be supported plus at least ½ inch for lateral clearance. Such a single bottle support 72 is described in the following embodiments.

Figure 6:
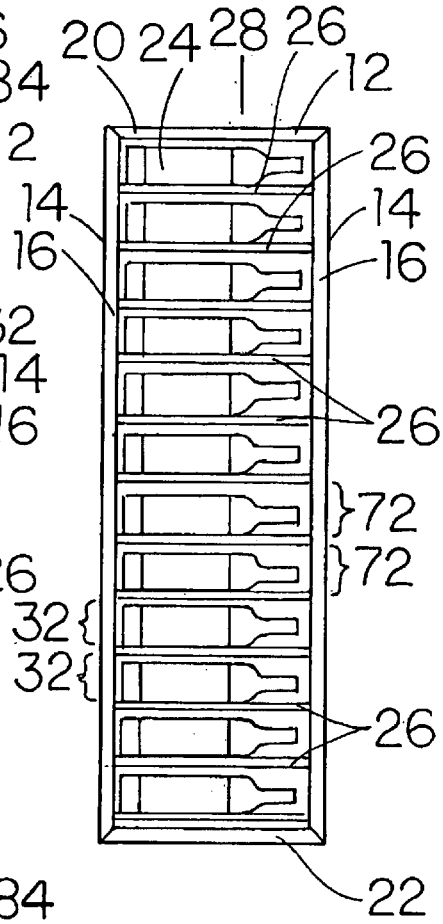
FIG. 6 is a front view of the wine rack apparatus, wherein wine bottles are stored in a single column of bottle supports.
Figure 7:
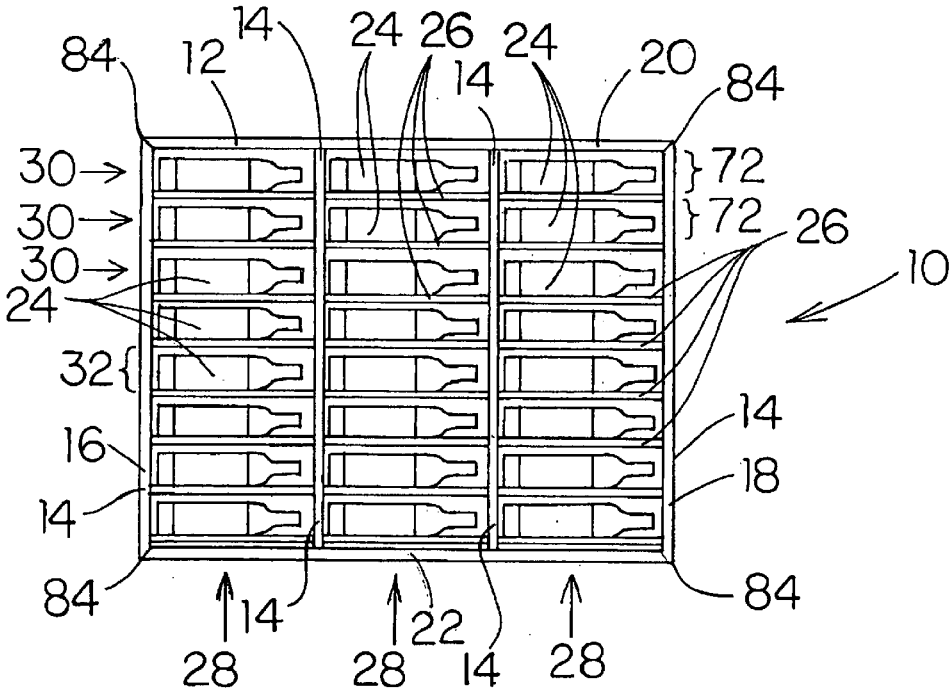
FIG. 7 is a front view of the assembled wine rack, showing the wine rack sized for storing wine bottles or the like in three columns of bottle supports.

In one embodiment, the apparatus 10 will support one column 28 of one or more single bottle supports 72. As shown in FIG. 6, an apparatus 10 with one column 28 has two vertical supports 14 which constitute the first and second sides 16, 18 of the planar frame 12. In other embodiments, the apparatus 10 will support two columns 28 of one or more single bottle supports 72. As shown in FIG. 1B, a two-column apparatus 10 comprises three vertical supports 14 spaced apart horizontally, the outer vertical supports 14 comprising the first and second sides 16, 18 of the planar frame 12. In yet other embodiments, the apparatus 10 will support three columns 28 supporting one or more single bottle supports 72. As shown in FIG. 7, the three column configuration of the apparatus 10 comprises four vertical supports 14 spaced apart horizontally, the outer two vertical supports comprising the first and second sides 16, 18 of the planar frame 12 of the apparatus 10. The number of columns 28 desired in any embodiment of the apparatus 10 thus will require one more vertical support 14 than the total number of columns desired.

Each single bottle support 72 has a width sufficient to receive an average wine bottle 24 horizontally, i.e. laid on its side. To achieve this, in one embodiment, the vertical supports 14 for the column 28 in which the single bottle support 72 is located are horizontally spaced apart the length of an average wine bottle 24 plus at least approximately ½ inch to provide clearance. In other embodiments, the vertical supports 14 are horizontally spaced apart about sixteen inches.

Figure 2:
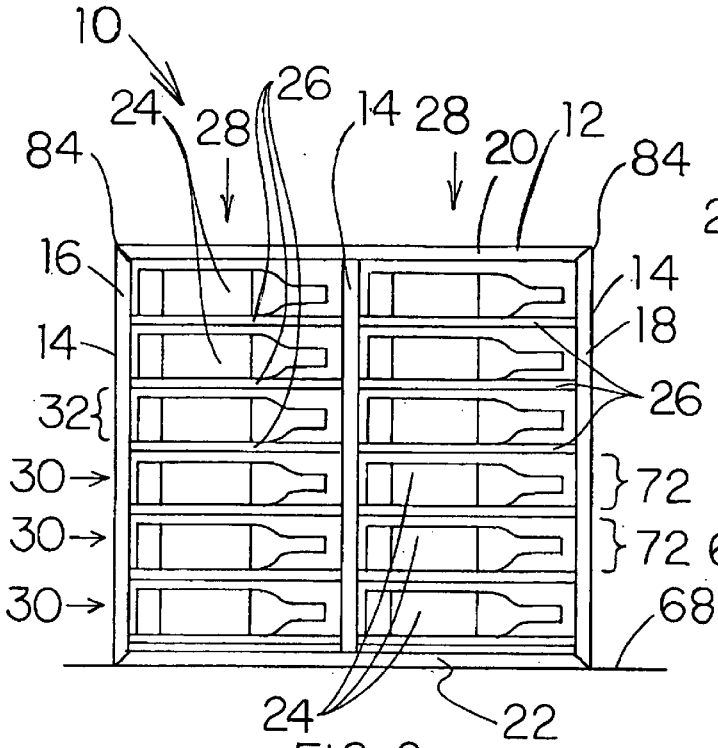
FIG. 2 is a front view of an assembled, free standing wine rack sized for receiving a plurality of wine bottles or the like in two columns of single bottle supports.
Figure 3:
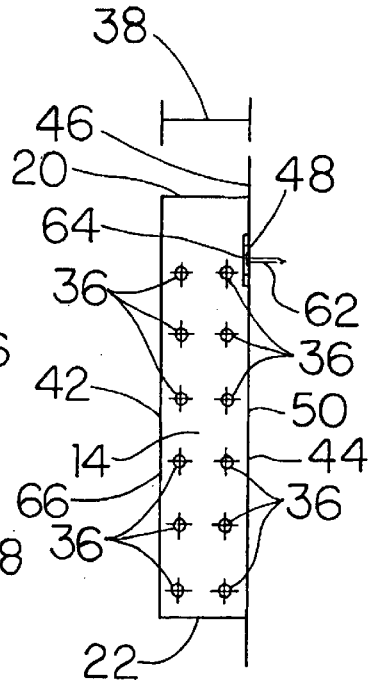
FIG. 3 is a partial side view of the assembled wine rack, showing the wine rack mounted to a wall.

As indicated above, the number of bottle supports 32 within each column 28 depends upon the number of rows 30 of pairs of dowels 26 in the column. In one embodiment, a two-column apparatus 10 has six rows 30 of dowels 26 in each column 28 for supporting a total of twelve wine bottles 24. This is shown in FIG. 2. FIG. 7 shows a three-column apparatus 10 having eight rows 30 of dowels 26 in each column 28 for a total of twenty-four bottles 24 supported in that embodiment of the apparatus 10. Alternatively, as shown in FIG. 1B and in FIG. 6, the apparatus 10 may have twelve rows 30 of dowels 26 in each column 28. In yet other embodiments, the apparatus may contain a sufficient number of rows 30 of dowels 26 in each column 28 for the apparatus 10 to extend from the floor to the ceiling of the room in which the apparatus 10 is located. In any embodiment, each pair of dowels 26 should be vertically spaced from every other pair of dowels at least four inches.

Figure 5:
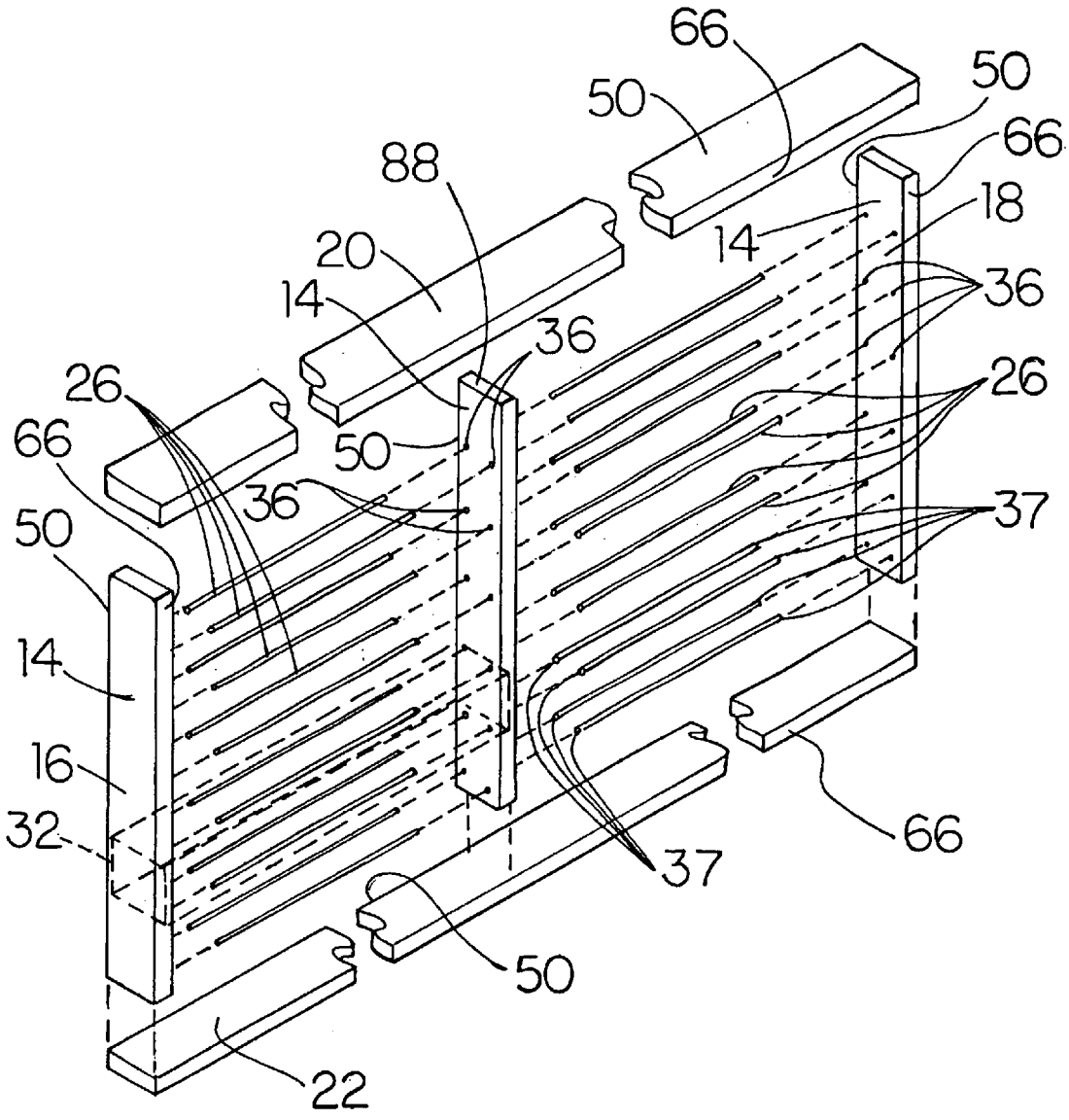
FIG. 5 is an exploded view of the component parts of the wine rack apparatus, in spaced position for assembly.

FIG. 5 shows an exploded view of one embodiment of the apparatus 10 showing the component parts of the apparatus in position for assembly. Although FIG. 5 shows dowels 26 that extend only between each pair of adjacent vertical supports 14, in other embodiments vertical supports 14 located between the first and second sides 16, 18 may provide dowel apertures 36 that extend completely through the vertical support such that a single dowel 26 may extend between more than one vertical support 14. For example, in the embodiment shown in FIG. 1A, one or more of the dowels 26 illustrated may extend between the first side 16 and the second side 18 by inserting the dowel 26 through a through-aperture 36 correspondingly located within the vertical support 14 spaced between the first and second sides 16, 18.

In one embodiment, the components of the apparatus 10 are manufactured of wood. The type of wood utilized depends upon manufacturing preference. In other embodiments, the components of the apparatus 10 are manufactured of suitable plastic materials. In yet other embodiments, the components of the apparatus 10 are manufactured of suitable metal materials.

In each embodiment, the one or more wine bottles 24 supported with the apparatus 10 extend substantially horizontally and transversely between the vertical supports 14. As a result, the planar frame 12 may be as thin as the largest thickness 40 of the largest wine bottle 24 supported within the apparatus 10.

The number of wine bottles 24 received in each column 28 may vary by increasing or decreasing the number of rows 30 of pairs of dowels 26 and thus the number of bottle supports 32 therein. Each pair of dowels 26 in one embodiment is spaced vertically apart within each column 28 from other pairs of dowels in the same column a distance from about four inches to about six inches, or otherwise a distance sufficient to selectively insert and remove a wine bottle 24 from the apparatus 30. As shown in FIG. 2, six bottles 24 may be stored in each column 28; however, it is well within the scope of one of average skill in the art to add or subtract additional pairs of dowels 26 by increasing the height of the vertical supports 14 to suit the needs of the user.

For example, a floor to ceiling apparatus (not shown) with pairs of dowels spaced from each other vertically about four inches apart would store approximately twenty-four bottles in a single column. In other embodiments, a wall mounted apparatus 10 measuring approximately eight feet tall by approximately eight feet wide and about four inches deep will support approximately one hundred forty-four wine bottles.

Figure 9:
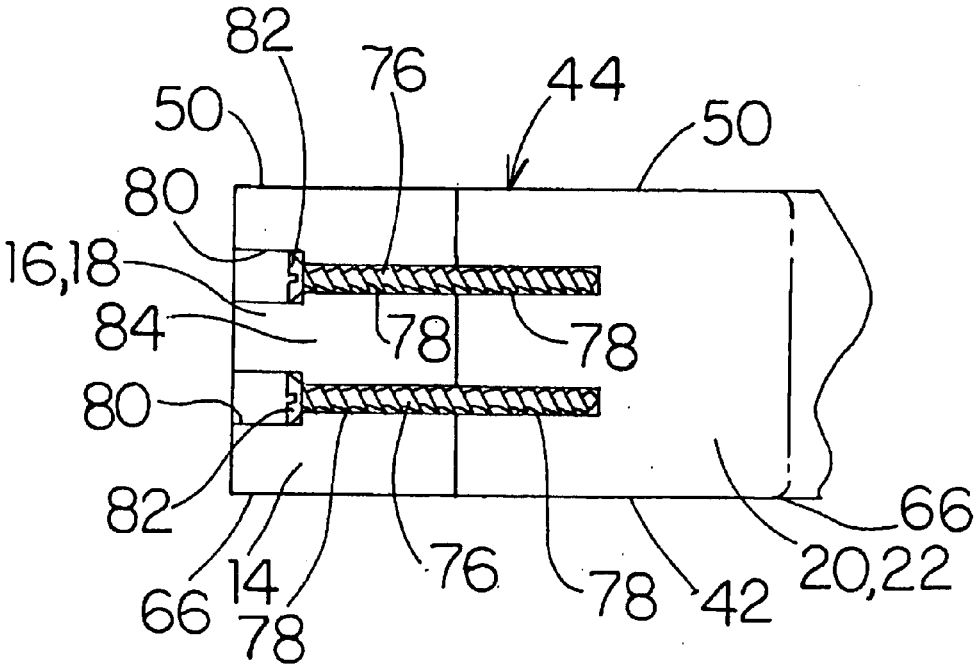
FIG. 9 is a partial cross sectional view of the wine rack apparatus along lines 9—9 of FIG. 1A.

In one embodiment, the front edge 66 of the vertical supports 14 is routed to provide a decorated surface. In other embodiments, the corners 84 of the peripheral frame 12 (i.e. junction of the ends of the horizontal top with the top of the first and second sides respectively and the junction of the horizontal bottom with the bottom of the first and second sizes respectively) are abutting and secured as shown in FIG. 9. In yet other embodiments, a decorative trim 74 may be provided and secured to the front edges 66 of the first and second sides 16, 18 and the horizontal top 20 and bottom 22 of the planar frame 12 and mitered at 45 degrees to appear similar to the corners of a picture frame as shown in FIGS. 1A, 1B, 1C, 2, 6, 7, and 10. Such a trim 74 may additionally be secured to the front edge 66 of any other vertical supports 14 contained within the apparatus 10.

Figure 10:
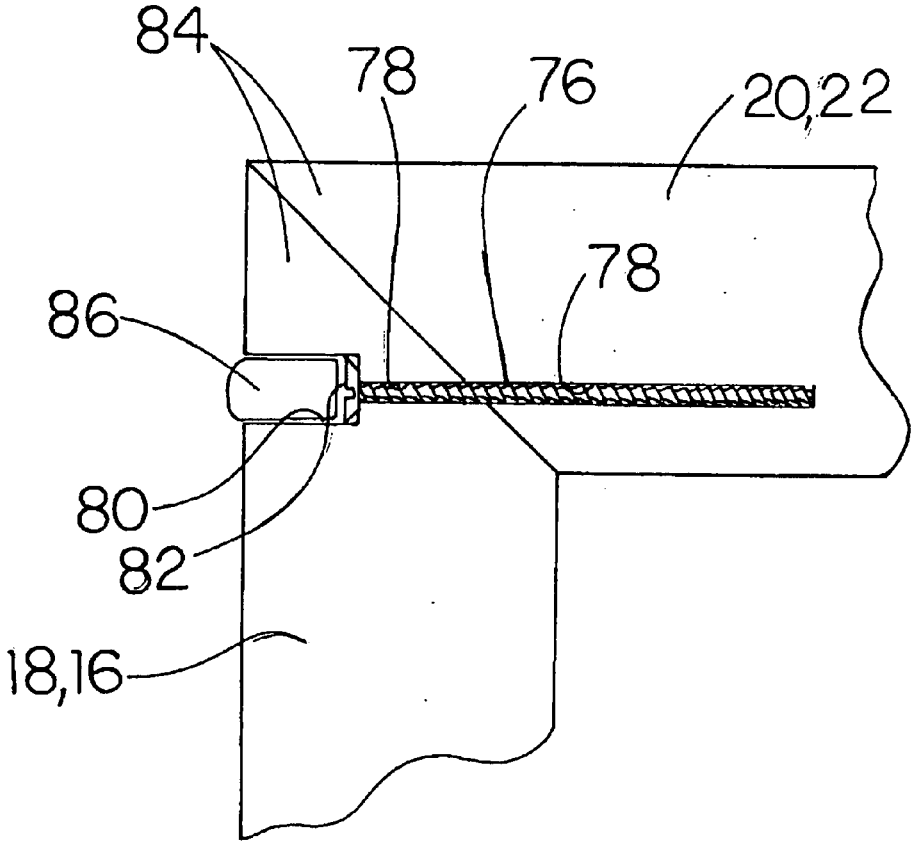
FIG. 10 is a partial cross sectional view of the wine rack apparatus trim along lines 10—10 of FIG. 1A.

Manufacture of the embodiments of the apparatus 10 as disclosed herein is well within the skill of a person of ordinary skill in the art. One process for assembling the planar frame 12 of the apparatus 10 is disclosed generally in FIGS. 9, 10 and 11. In the embodiments disclosed in FIGS. 9 and 10, the corners 84 of the planar frame 12 or in the case of FIG. 10, the trim 74, are fastened together with appropriate fasteners 76, such as nails or screws. As shown in FIGS. 9 and 10, the fasteners 76 are inserted into pre-drilled holes 78. In one embodiment, the pre-drilled hole 78 in the entry side provides a countersunk hole 80 in order to hide the head 82 of the fastener 76 by a plug 86.

Figure 11:
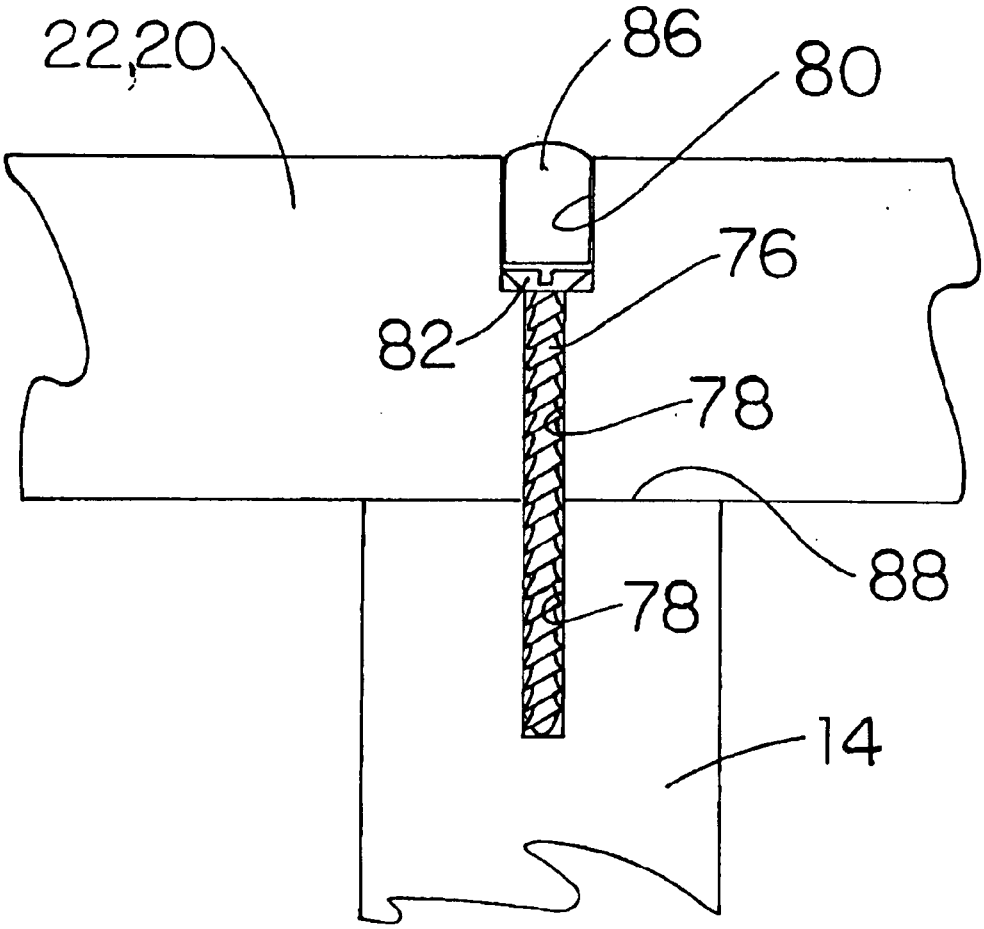
FIG. 11 is a partial cross sectional view of the wine rack apparatus like FIG. 9 showing the securance of the vertical supports to the top and bottom of the wine rack apparatus.

The assembly of embodiments of the apparatus 12 for securing the vertical supports 14 other than the first or second sides 16, 18 is shown in FIG. 11. The horizontal top 20 and the horizontal bottom 22 are secured to the vertical support 14 extending between them in a manner similar the method of securing the corners 84 of the planar frame 12. A fastener 76 is inserted into pre-drilled holes 78 in the horizontal top 20, horizontal bottom 22 and the ends 88 of the vertical support 14. In one embodiment, the pre-drilled holes 78 in the side of the horizontal top 20 and horizontal bottom 22 in which the fastener 76 is inserted provide countersunk holes 80 in order to hide the head 82 of the fastener 76. In other embodiments, the assembly of elements being secured together in this way may additionally be achieved using an alternative or supplemental measure such as gluing or using some other type of adhesive (not shown) at the point of connection. In yet other embodiments, a plug 86 is inserted into the countersunk hole 80 for masking the countersunk hole.

Finishing may be applied to the component parts shown in FIG. 5, such as paint, stain, or other finishing to suit the needs of the user. In one embodiment, such finishing is applied prior to assembly of the apparatus 10. In other embodiments, the finishing is applied after assembly of the apparatus 10.

In one embodiment, the apparatus 10 may be provided to the user in pre-assembled form. In other embodiments, the apparatus 10 is provided to the end user unassembled in knock-down form for ease of shipping, a set of instructions accompanying the knock-down assembly of elements to enable the end user to assemble the apparatus 10, for example as shown in the exploded view of FIG. 5. In the knock-down form, the apparatus 10 may be assembled with a screwdriver and glue, which is well within the skill of most end users.

Although embodiments of the present invention have been illustrated and described herein, it will be understood that these embodiments are selective and exemplary of all possible embodiments of the present invention. It is intended that revisions and adaptations be construed as falling within the limits of the scope of the following claims:

What is claimed is:

1. An apparatus for horizontally storing one or more bottles of wine, comprising: a planar frame comprising a top, a bottom, and two or more laterally spaced apart vertical supports, said frame defining at least one column, each said column having at least one row comprising at least one bottle support, each said bottle support comprising a pair of spaced apart dowels extending substantially horizontally between two of said vertical supports, each said bottle support configured to receive at least one wine bottle to be transversely supported thereon, each said pair of dowels being laterally spaced apart a distance less than the thickness of said wine bottle, said adjacent vertical supports being spaced apart a distance at least greater than the length of one said wine bottle.

2. The apparatus of claim 1 wherein each said bottle support can receive two or more wine bottles.

3. The apparatus of claim 1 wherein each said bottle support can receive a single wine bottle.

4. The apparatus of claim 1 wherein each said pair of dowels is laterally spaced apart about two inches.

5. The apparatus of claim 1 wherein each dowel in each said pair of dowels is circular in cross section.

6. The apparatus of claim 5 wherein each said dowel has a thickness from about ⅛ inch to about ½ inch.

7. The apparatus of claim 1 wherein the ends of each dowel in each said pair of dowels is secured to one of said vertical supports in corresponding apertures bored laterally into said vertical supports, said apertures configured to receive said ends.

8. The apparatus of claim 7 wherein one of said vertical supports contains through-apertures, said dowels extending from said apertures in one of said vertical supports, through said through-apertures in another of said vertical supports, to said apertures in a third of said vertical supports.

9. The apparatus of claim 1 wherein said planar frame defines one column of one or more said bottle supports, said planar frame comprising said top and said bottom connected at respective distal ends thereof by first and second sides comprising said vertical supports.

10. The apparatus of claim 9 wherein said one column has at least two said bottle supports, said bottle supports being vertically stacked within said one column.

11. The apparatus of claim 1 wherein said planar frame defines two columns of one or more said bottle supports, said planar frame comprising said top and said bottom connected at respective distal ends thereof by first and second sides and a medial vertical support spaced between said first and second sides, said first and second sides and said medial vertical support comprising said vertical supports.

12. The apparatus of claim 11 wherein each of said two columns has at least two said bottle supports, said bottle supports being vertically stacked within each of said two columns.

13. The apparatus of claim 1 wherein said planar frame defines three columns of one or more said bottle supports, said planar frame comprising said top and said bottom connected at respective distal ends thereof by first and second sides and first and second medial vertical supports spaced between said first and second sides, said first and second sides and said first and second medial vertical supports comprising said vertical supports.

14. The apparatus of claim 13 wherein each of said three columns has at least two said bottle supports, said bottle supports being vertically stacked within each of said three columns.

15. The apparatus of claim 1 wherein each said column has at least two said bottle supports, said bottle supports being vertically stacked within each said column.

16. The apparatus of claim 15 wherein said pair of spaced apart dowels in one of said bottle supports is vertically spaced from each other said pair of spaced apart dowels in vertically adjacent said bottle supports a distance at least greater than the thickness of said wine bottle.

17. The apparatus of claim 16 wherein said distance is from about 4 inches to about 6 inches.

18. The apparatus of claim 1 wherein each said vertical support is laterally spaced apart from each other said vertical support a distance at least greater than the length of said wine bottle.

19. The apparatus of claim 18 wherein said distance is about 16 inches.

20. The apparatus of claim 18 wherein said distance is at least greater than the length of more than one said wine bottle laid end to end.

21. The apparatus of claim 1 wherein said planar frame also has a front and a back, said apparatus further comprising at least one mounting device secured to said back for mounting said apparatus to a vertical wall.

22. The apparatus of claim 1 wherein said planar frame also has a front and a back, the linear distance between said front and said back defining the depth of said apparatus, said depth being at least as great as the thickness of said wine bottle.

23. The apparatus of claim 22 wherein said depth is from about 4 inches to about 5 ½ inches.

24. The apparatus of claim 1 wherein said apparatus is configured to be mounted to a horizontal surface, one or both of said bottom and said top being secured to said horizontal surface with fastening means for securing said apparatus.

25. The apparatus of claim 1 wherein said planar frame extends between the floor and ceiling of a room in which said apparatus is located.

26. The apparatus of claim 1 wherein said apparatus is manufactured of materials selected from the group of materials consisting of wood, plastic and metal.

27. The apparatus of claim 1 wherein said planar frame has a front and a trim secured to said front.

28. The apparatus of claim 1 wherein a front edge of each of said top, said bottom, and said vertical supports is decoratively routed.

29. The apparatus of claim 1 wherein said apparatus is manufactured of wood and one or more of said vertical supports, said top, said bottom, and said dowels are coated with a finish selected from the group of finishes consisting of paint, stain and varnish.

30. An apparatus for horizontally storing one or more bottles of wine, comprising: a planar frame comprising a top and a bottom connected at respective distal ends thereof by first and second sides, at least one medial vertical support laterally spaced between said first and second sides, said first and second sides and said at least one medial vertical support defining at least two columns, each said column being bound above and below by said top and said bottom, respectively, each of said columns containing a plurality of vertically stacked bottle supports, each said bottle support comprising first and second dowels extending transverse of said column, each said bottle support configured to horizontally and transversely receive and support a wine bottle.

31. The apparatus of claim 1 wherein said vertical supports are spaced apart on-center about the on-center distance between adjacent studs in a vertical wall proximate to which said apparatus is positioned.

32. The apparatus of claim 1 wherein said vertical supports are spaced apart on-center about 16 inches.

33. The apparatus of claim 30 wherein said first side is spaced apart on-center from an adjacent said medial vertical support about the on-center distance between adjacent studs in a vertical wall proximate to which said apparatus is positioned, each said medial vertical support being spaced apart on-center from each adjacent said medial vertical support about said on-center distance, said second side being spaced apart on-center from an adjacent said medial vertical support about said on-center distance.

34. The apparatus of claim 30 wherein said first side, said medial vertical supports and said second side are all spaced apart from each other on-center about 16 inches.

* * * * *